US005452803A

United States Patent [19]

Stromberg

[11] Patent Number: 5,452,803

[45] Date of Patent: Sep. 26, 1995

[54] STACKABLE SHIPPING CONTAINERS

[76] Inventor: Per S. Stromberg, P.O. Box 65, N-2011lingen, N-2000, Strommenrom, Norway

[21] Appl. No.: 171,812

[22] Filed: Dec. 22, 1993

[51] Int. Cl.[6] ..... B65D 21/00

[52] U.S. Cl. ..... 206/507; 206/503; 206/511

[58] Field of Search ..... 206/503, 507, 206/508, 509, 511, 512; 220/6

[56] References Cited

U.S. PATENT DOCUMENTS

| | | | |
|---|---|---|---|
| 1,112,943 | 10/1914 | Stone | 206/511 |
| 3,347,394 | 10/1967 | Gould | 206/509 X |
| 3,355,054 | 11/1967 | Wilson | 220/23.6 |
| 3,481,502 | 12/1969 | Slayman | 206/511 X |
| 3,700,137 | 10/1972 | Souza | 206/511 |
| 3,998,328 | 12/1976 | Box | 206/511 |
| 4,139,098 | 2/1979 | Mollon | 206/507 |
| 4,170,313 | 10/1979 | Caves, et al. | 220/6 X |
| 4,210,252 | 7/1980 | Cooke et al. | 206/512 X |
| 4,673,087 | 6/1987 | Webb | 206/503 X |
| 4,757,910 | 7/1988 | Box | 220/71 |
| 4,889,235 | 12/1989 | Hess | 206/511 |
| 5,042,674 | 8/1991 | Ramsay et al. | 206/508 X |
| 5,184,726 | 2/1993 | Box | 206/511 |
| 5,285,895 | 2/1994 | Bolt | 206/511 X |
| 5,287,966 | 2/1994 | Stahl | 206/503 X |

*Primary Examiner*—Steven M. Pollard
*Attorney, Agent, or Firm*—Erwin Doerr

[57] ABSTRACT

A shipping container adapted to be stacked upon a like container includes upper surfaces associated with a pair of opposed walls of the container which surfaces include locating means adapted to cooperate with complimentary locating means provided on lower surfaces of a stacked container when those containers are put into vertically stacked longitudinal or transverse alignment, and complementary locating means, as aforesaid, associated with lower surfaces further including complementary guide means to enable stacking to be achieved by relative sliding between a pair of like containers until said upper and lower complementary locating means of the stacked containers are engaged whereafter further relative movement between containers is restricted.

9 Claims, 3 Drawing Sheets

STACKABLE SHIPPING CONTAINERS

This invention relates to shipping containers adapted to be stacked in either longitudinal or transverse vertical alignment upon like shipping containers to produce a stable multi-tier stack of such containers.

Shipping containers according to the invention may be formed from a variety of materials. If intended to be used for shipping fish products or produce, it is preferable that the containers injection moulded from a suitable plastics material. It is also preferred, but not essential, that such containers have side and end walls which are integrally hinged to the container base so that the containers can be collapsed when empty, for flat stacked return shipment. In some instances containers according to the invention will be furnished with lids but more usually will, other than the uppermost containers in a stack, be stacked open topped one tier upon the next.

When containers according to the invention contain fresh fish or produce, the contents will contain also ice, a combination which makes the container heavy for nanhandling.

Thus, the features of a container according to this invention seek to facilitate stacking by relative sliding movement of one (upper) container over another (lower) container until, when the containers are correctly aligned complementary locating means will be engaged to discourage further relative movement between the stacked containers.

To this end, one aspect of the present invention comprises a shipping container adapted to be stacked upon a like container includes upper surfaces associated with a pair of opposed walls of the container which surfaces include locating means adapted to cooperate with complementary locating means provided on lower surfaces of a stacked container when those containers are put into vertically stacked longitudinal or transverse alignment, and complementary locating means, as aforesaid, associated with lower surfaces further including complementary guide means to enable stacking to be achieved by relative sliding between a pair of like containers until said upper and lower complementary locating means of the stacked containers are engaged whereafter further relative movement between the containers is restricted.

An embodiment of the invention will now be described, by way of example, with reference to the accompanying drawings, in which.

Figure 1:
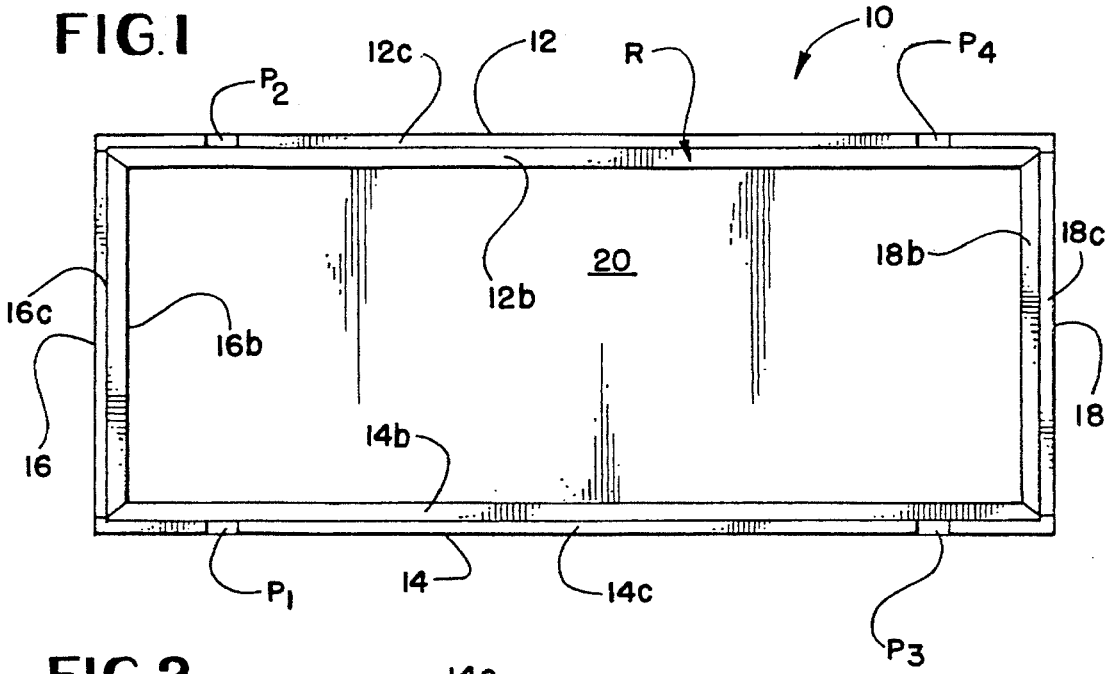
FIG. 1 is a top plan view of a container according to the invention showing the upper edge surfaces of the side and end walls thereof and the inner face of its base panel.

Referring to the drawings, there is shown a rectangular open top container 10 comprising a pair of parallel opposed side walls 12, 14, respectively, and a pair of parallel opposed end walls 16, 18, respectively, and a base panel 20. In this embodiment the container is formed from a plastics material by injection moulding and has collapsible side and end walls. Thus, side walls 12, 14 and end walls 16, 18 are integrally hinged at their lower edges to respective side and end edges of the base panel 20 and can be folded into a collapsed position in which all the panels of the container are then substantially co-planar or raised into an erected position to form the open top container. Of course, FIG. 1 shows the container in its erected state and suitable locking means "L" (FIG. 2) are provided to maintain the wall panels upstanding so that the container can be used. The invention is not limited to collapsible containers nor indeed to plastics containers. In some instances the container may be provided with a lid to close, at least partially, the open top of the container.

Figure 2:
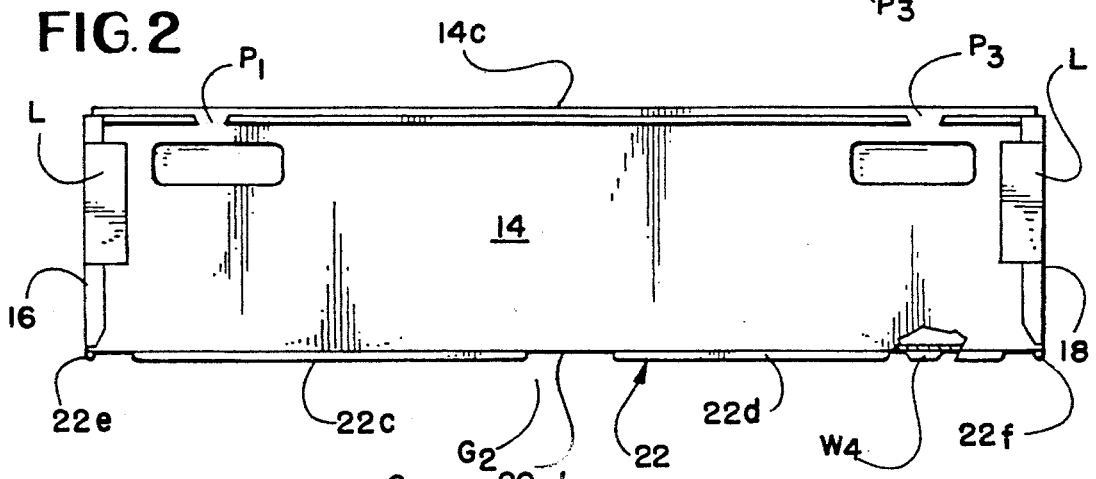
FIG. 2 is a side view of the container with a small lower portion of the side wall shown broken away.
Figure 3:
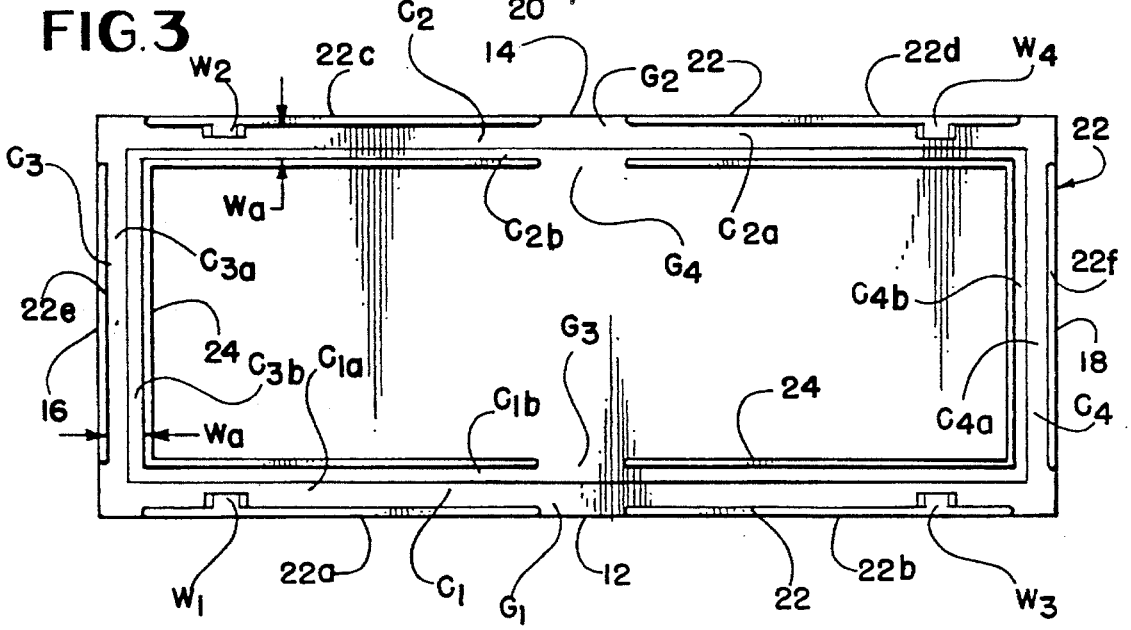
FIG. 3 is a bottom plan view of the container showing the lower edge surfaces of the side and end walls thereof and the outer face of its base panel.
Figure 4:
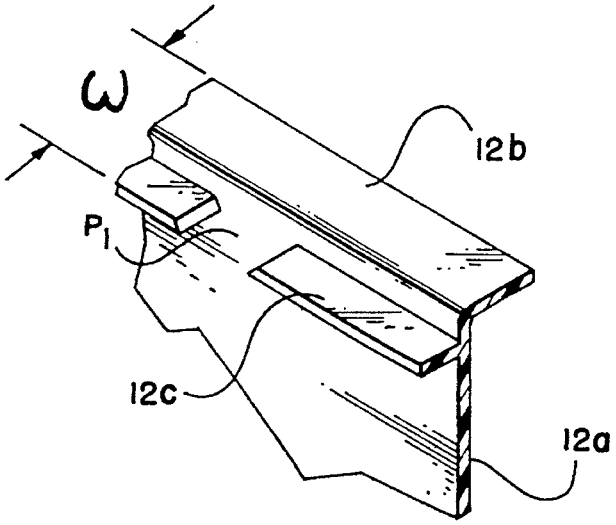
FIG. 4 is a perspective scrap sectional view of an upper portion of one of the side walls of the container.
Figure 5:
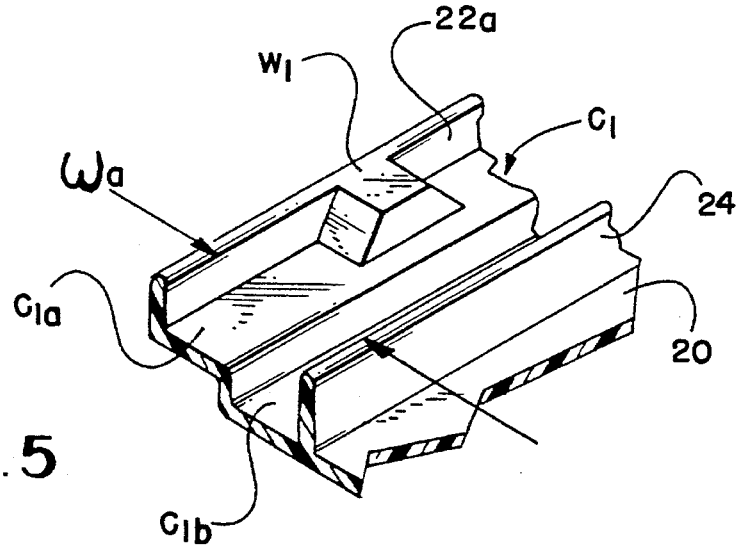
FIG. 5 is a perspective scrap sectional view of a side edge of the outer face of the base panel.

In order to facilitate secure stacking of one container according to the invention atop another like container the upper and lower faces of each container are furnished with complimentary features. Referring in particular to FIGS. 1, 2 and 4 hereof such features as are present at the upper end of the container will now be described in more detail. Each side and end wall is similar to the extent at least that each wall comprises a main wall panel, an inwardly extending top edge flange and an outwardly extending top guide rail. More specifically, as best seen in FIG. 4, side wall panel 12 includes a main wall panel **12*a* at the extreme upper edge of which is formed an integral inwardly extending flange 12*b*. The upper edge of main wall panel 12*a* also includes an integral outwardly extending guide rail 12*c* which is stepped downwardly, i.e. towards bottom panel 20, of the wall relative to the upper edge flange 12*b*. All the other walls of the container include similar features and like parts are designated like reference suffixes. Thus, as best seen in FIGS. 1 and 4, the upper flanges and guide rails of all the walls together provide a top rim R having an overall width w. Each of the side wall guide rails 12*c* and 14*c* is formed with a pair of spaced openings P1, P2, P3, P4 therein, formed adjacent each of the walls 16 and 18**. It is envisaged that the openings need not require removal of the complete depth of the rail but may comprise only a recess therein and the term opening in this context is to be construed accordingly. These guide rails and openings are some of the elements of complementary location means provide to facilitate container stacking.

Other elements of the complementary locating means are provided on the base of the container and are best seen with particular reference to FIGS. 2, 3, 5 and 6. The outer surface of base panel 20 is formed with a pair of spaced rib structures; an outer peripheral rib structure 22 and an inner peripheral rib structure 24. The peripheral rib structures are not continuous and thus the outer structure comprises aligned longitudinal rib sections **22*a* and 22*b* which are integral continuations of side wall 12 and are spaced from one another by a gap $G_1$. Similarly, longitudinal rib sections 22*c*, 22*d* are integral continuations of side wall 14 and spaced apart by a gap $G_2$. A transverse rib section 22*e* is provided by an integral continuation of end wall 16 and a like transverse rib section 22*f* is an integral continuation of end wall 18. The inner peripheral rib structure 24 has its longitudinal and transverse rib sections joined other than gaps $G_3$ and $G_4$ in the opposed longitudinal sections is a continuous rib structure. Gaps $G_3$ and $G_4$ are aligned with gaps $G_1$ and $G_2$, respectively, in the outer peripheral rib structure. The rib sections of the outer peripheral structure are spaced from those of the inner peripheral structure by a distance Wa which substantially corresponds to the distance w which is the combined widths of top flange 12*b* and guide rail 12*c***. Thus, the inner and outer peripheral rib structures together define between them longitudinal and transverse channels $C_1$, $C_2$; $C_3$, $C_4$ in the base panel. Each of the longitudinal rib sections and the transverse rib sections stop short of the adjacent corner of the base panel substantially by distance wa and hence access to the channels $C_1$, $C_2$ provided between inner and outer longitudinal rib sections and to channels $C_3$, $C_4$ provided between the inner and outer transverse rib sections is facilitated from each of the ends and from each of the sides, respectively, of the container.

Locating wedges $W_1$, $W_3$ and $W_2$, $W_4$ are provided in channels $C_1$ and $C_2$, respectively, and are sized to be received in the openings $P_1$, $P_3$ and $P_2$, $P_4$ respectively when two like containers according to the invention are stacked one atop the other in longitudinal alignment. Locating wedges $W_1$ and $W_3$ are formed integrally with outer longitudinal rib sections 22*a* and 22*b*, respectively, and locating wedges $W_2$ and $W_4$ are formed integrally with outer longitudinal rib sections 22*c* and 22*d*, respectively. All the locating wedges are substantially the same height as their associated rib sections and hence are flush with the walls of their respective channels defined by the inner and outer rib sections.

When one container is being stacked in longitudinal alignment upon another container, stacking is normally achieved by sliding the base of the upper container over the top of the lower container. Assuming that the lower container has no lid, the longitudinal sections of rib structure 22 and 24, which provide channels $C_1$ and $C_2$ receive the top flange and guide rails of the lower container as the upper container is pushed along the top of the lower container. During this sliding movement the locating wedges $W_1$, $W_4$ of the upper container ride along the guide rails 12*c*, 14*c* of the lower container and the top flanges 12*a*, 12*b* of the lower container are thereby held clear of the floors $C1_a$, $C1_b$; $C2_a$, $C2_b$ of the respective channels $C_1$, $C_2$ until such time as the containers are properly vertically aligned giving vertical alignment between the locating wedges $W_1$, $W_3$; $W_2$, $W_4$ and guide rail openings $P_1$, $P_3$; $P_2$ $P_4$ respectively. When vertical alignment is achieved locating wedges W1, W2 seat in guide rail openings P1, P2 respectively and locating wedges W3, W4 seat in guide rail openings P3, P4 respectively whereby the upper container settles down onto the peripheral rim of the lower container. When alignment and location occurs, at the sides of the container the top flange 12*b* and guide rail 12*c* seat on the floor $C1_a$ and $C1_b$ Of channel $C_1$, respectively; Top flange $14_b$ and guide rail $14_c$ seat on the floor $C2_a$ and $C2_b$ of channel $C_2$ respectively. Likewise, at the ends of the container top flange 16*b* and guide rail $16_c$ seat on the floor $C_3$a and $C_3$b of channel $C_3$ respectively, and top flange $19_b$ and guide rail $18_c$ seat on the floor $C4_a$ and $C4_b$, respectively, of channel $C_4$. Thus, the containers are interengaged and further relative sliding or relative rotation between the stacked containers is prevented.

Figure 6:
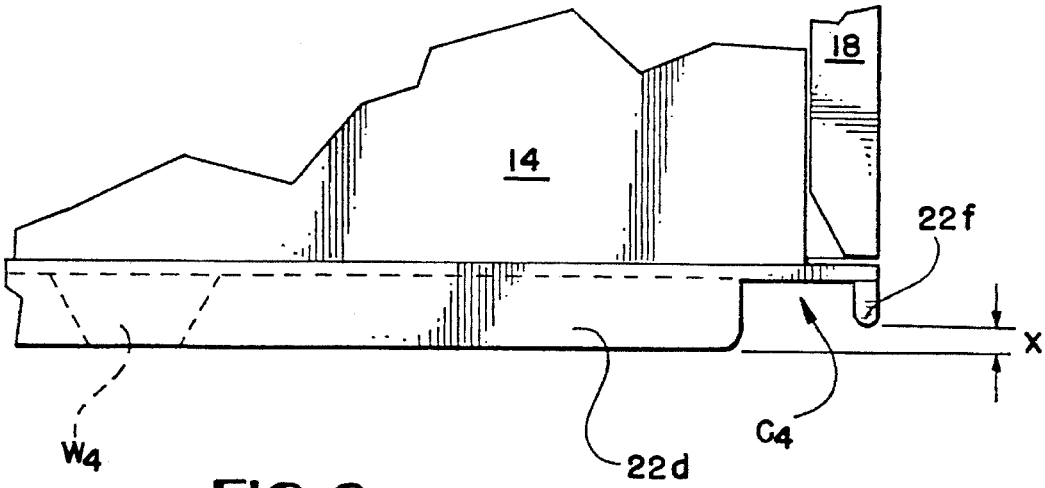
FIG. 6 is a scrap side elevation at one end of the container showing a part of a side and end wall thereof.

In order to facilitate the mounting of one container upon another and initiate the relative sliding movement, each of the transverse outer rib sections 22*c* and 22*f* are of lesser depth than the longitudinal rib sections 22*a*, 22*b* and 22*c*, 22*d* by an amount "x" as best seen in FIG. 6. This arrangement gives a leading edge clearance when the containers are slide stacked and also gives ground clearance to enable blade type container handling forks to be inserted endwise beneath a grounded container to lift either a single container or a stack of containers from the ground or other support structure.

A group of containers comprising a pair of containers disposed in parallel longitudinal side-by-side relationship and a single transverse container disposed at one end of the pair may also receive a cross-stacked like group of containers, all such containers being in accordance with the present invention. Indeed in order to form a stable stack of two or more tiers of such containers it is preferred that alternate tiers are cross-stacked so that the single transverse container is at the opposite end of the group in alternate tiers. In this way the pair of longitudinal containers in each group interconnect the transverse and longitudinal containers in the tier below that group. To this end the length to width ratio of containers according to the invention is chosen to be 2:1.In that instance, as is apparent from FIGS. 1, 2, 3, and 7, the guide rail openings P1 through P8 and the wedges W1 through W4 are located at a distance from the respective corners which corresponds to about one fourth of the width of the container.

Figure 7:
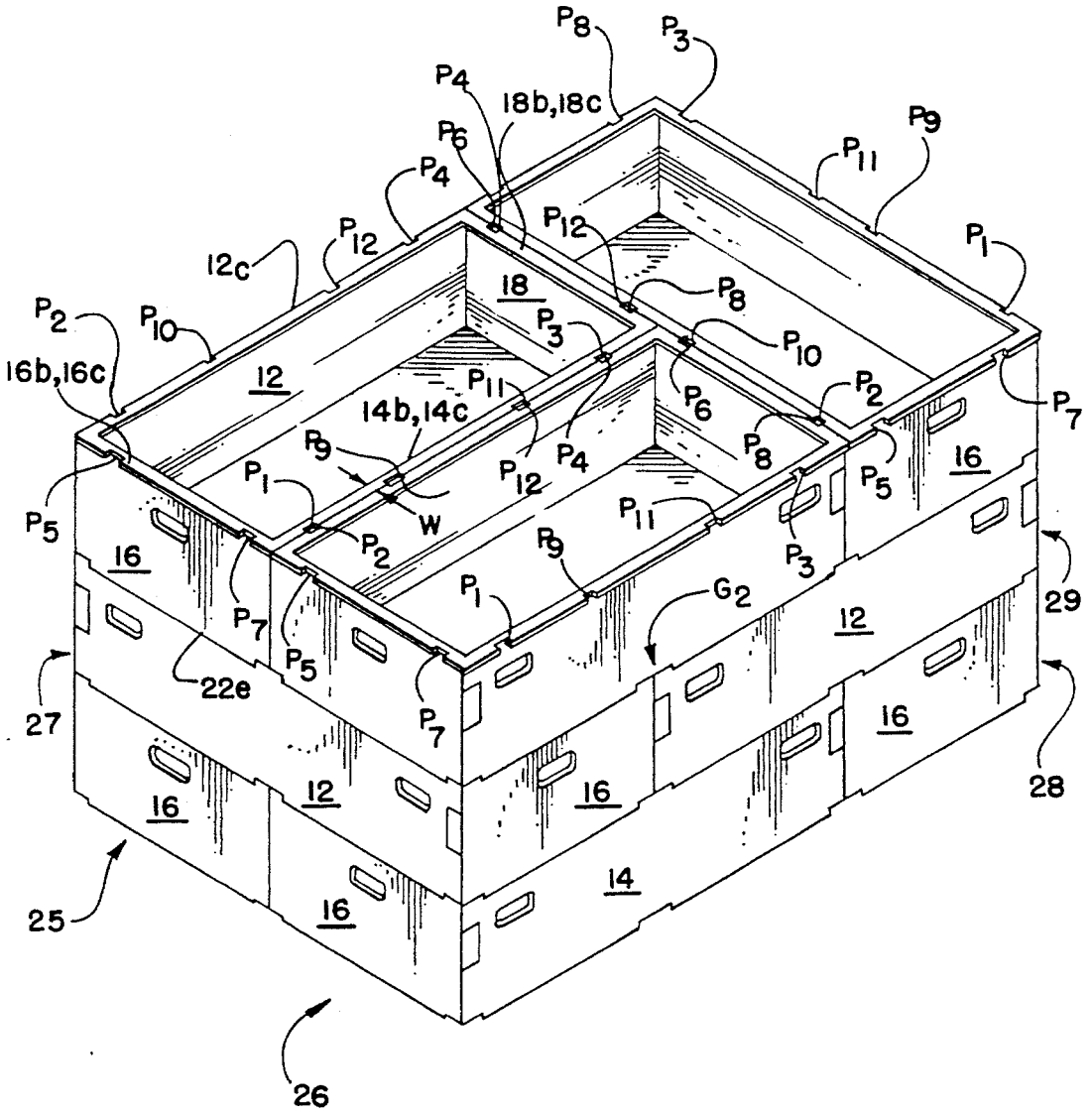
FIG. 7 is a perspective view of three tiers of stacked containers according to the invention.

In instances where cross-stacking of the containers is intended, the transverse guide rails such as $16_c$ and $18_c$ will be provided with guide rail openings $P_5$, $P_7$, $P_6$ and $P_8$ while longitudinal top flanges such as $12_c$ and $14_c$ will be provided with additional guide rail openings $P_9$, $P_{11}$, $P_{10}$ and $P_{12}$, as shown in FIG. 7. All these additional openings are of the same construction as that of the guide rail openings $P_1$, described hereinabove; openings $P_5$, $P_7$, $P_6$, and $P_8$ are located at the same distance from the adjacent corner as openings $P_1$, $P_2$, etc. On the other hand, guide rail openings $P_9$ and $P_{11}$ and $P_{10}$ and $P_{12}$ are located at the same distance but measured from the transverse center line of the container. It will be understood that in a cross-stacked arrangement, wherein for instance one transversely arrangec container 27 is positioned atop longitudinally arranged lower like container 25, 26, the locating wedge $W_1$ provided at the bottom of upper container 27 will engage guide rail opening $P_7$ of lower longitudinal container 25 while locating wedge $W_3$ will engage opening $P_5$ on the adjacent, longitudinally oriented, container 26; of course, locating wedges $W_2$ and $W_4$ would extend into the open space of longitudinally arranged containers 25 and 26 below. On the other hand, when container 29 is stacked on lower containers 28 and 26 so that one end wall of container 29 is aligned with the side wall of container 28 below, locating wedge W3 will engage guide rail opening $P_{11}$ of container 26 while wedge $W_1$ will mate with guide rail opening $P_7$ provided in the transverse top flange of lower container 28; furthermore, locating wedge $W_4$ engages opening $P_{12}$ while wedge $W_2$ extends into the open space of container 28 below. Gaps $G_1$, $G_3$ and $G_2$, $G_4$ provided in the peripheral rib structure on the bottom of the containers are dimensioned so as to accommodate the tope flanges and guides of two adjacent containers disposed below in side-by-side or side-to-end relationship.

Whereas the above description refers to the stacking of open topped containers, it is envisaged that containers according to the invention may be furnished with a lid. In this event is the lid which will include locating elements (not shown) for cooperation with the base channels of a stacked container and upper surfaces of the container are to be construed to include either the flanges and guide rails of the container top rim or, alternatively, equivalent areas of a container lid.

The arrangement whereby two longitudinal containers and one transverse container are provided in a group for stacking is shown because the arrangement substantially fills the surface area of a standard European shipping pallet. Moreover, in the case of collapsible containers, each container, when in a flat collapsed condition is sized substantially to cover the surface area of a standard European pallet.

Of course, the same dimensional relationship may be selected for differently sized pallets.

What is claimed is:

1. A shipping container adapted to be stacked upon a lower like container comprising a base having side- and end edges, pairs of opposed side- and end walls interconnected with each other and said base, said pair of opposed side- and end walls having upper surfaces which include locating means, said base having edge portions adjacent said side- and end edges thereof and locating means provided in said side edge portions and arranged to cooperate with the locating means associated with said upper surfaces of the like container below, said upper surfaces and said edge portions of said base further including complementary guide means arranged to permit stacking of said container upon the lower like container by relative sliding movement between said containers until said locating means provided in said edge portions of the base of said container are engaged in the locating means provided in the upper surfaces of said lower like container, said guide means in the edge portions of said base comprising a peripheral channel formed from spaced inner and outer rib sections extending downwardly from the exterior surface of said base and spaced apart at a distance so as to accommodate the top rim portion of a lower like container, said upper surfaces of said side and end walls comprising an outwardly extending guide rail and a flange extending inwardly and slightly above said guide rail to form a top rim.

2. The shipping container according to claim 1 wherein said locating means associated with said upper surfaces of said side- and end walls comprises openings provided in said guide rail.

3. The shipping container according to claim 2 wherein said locating means associated with said base comprises wedges arranged along said side edges of said base in vertical alignment with certain of the openings in the upper surfaces of said side walls, permitting said wedges to be engaged in openings provided in the upper surfaces of the like container below when stacked thereupon.

4. The shipping container according to claim 3 wherein said locating wedges have mutually inclined faces and said openings have complementary inclined faces.

5. The shipping container according to claim 1 wherein the length to width ratio of said container is 2:1.

6. The shipping container according to claim 5 wherein said wedges provided along said side edges of said base and said openings in said guide rails are disposed at a distance from the respective corners corresponding to approximately one fourth of the width of said container.

7. The shipping container according to claim 6 wherein intermediate openings are provided in the guide rails associated with said side walls at a distance from the vertical center line of said side walls corresponding to approximately one fourth of the width of said container.

8. A shipping container adapted to be stacked upon a lower like container comprising a base having side and end edges, pairs of opposed side and end walls interconnected with each other and said base, said pair of opposed side and end walls having upper surfaces which include locating means, said base having edge portions adjacent said side and end edges thereof and locating means provided in said side edge portions and arranged to cooperate with the locating means associated with said upper surfaces of the like container below, said upper surfaces and said edge portions of said base further including complementary guide means arranged to permit stacking of said container upon the lower like container by relative sliding movement between said containers until said locating means provided in said edge portions of the base of said container are engaged in the locating means provided in the upper surfaces of said lower like container, said guide means in the edge portions of said base comprising a peripheral channel formed from spaced inner and outer rib sections extending downwardly from the exterior surface of said base and spaced apart at a distance so as to accommodate the top rim portion of a lower like container, said outer rib sections extending downwardly in extension of said side and end walls, the outer rib sections associated with said end walls extending downwardly to a lesser extent than the rib sections associated with said side walls to facilitate said relative sliding movement.

9. A shipping container adapted to be stacked upon a lower like container comprising a base having side and end edges, pairs of opposed side and end walls interconnected with each other and said base, said pair of opposed side and end walls having upper surfaces which include locating means, said base having edge portions adjacent said side and end edges thereof and locating means provided in said side edge portions and arranged to cooperate with the locating means associated with said upper surfaces of the like container below, said upper surfaces and said edge portions of said base further including complementary guide means arranged to permit stacking of said container upon the lower like container by relative sliding movement between said containers until said locating means provided in said edge portions of the base of said container are engaged in the locating means provided in the upper surfaces of said lower like container, said guide means in the edge portions of said base comprising a peripheral channel formed from spaced inner and outer rib sections extending downwardly from the exterior surface of said base and spaced apart at a distance so as to accommodate the top rim portion of a lower like container, said outer rib sections terminating at a distance from the respective corners of the container corresponding to the width of the top rim portion associated with the upper surfaces of said side and end walls to facilitate the sliding movement of said container when being stacked upon a like container below, said outer and inner rib sections being interrupted at a location intermediate said side walls for a distance approximately twice the combined width of said guide rails and flanges to facilitate cross stacking.

* * * * *